US006726121B1

(12) United States Patent
Kienzler et al.

(10) Patent No.: US 6,726,121 B1
(45) Date of Patent: Apr. 27, 2004

(54) COMMON RAIL INJECTOR

(75) Inventors: Dieter Kienzler, Leonberg (DE); Patrick Mattes, Stuttgart (DE); Wolfgang Stoecklein, Stuttgart (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 310 days.

(21) Appl. No.: 09/806,716

(22) PCT Filed: Aug. 1, 2000

(86) PCT No.: PCT/DE00/02530

§ 371 (c)(1),
(2), (4) Date: Aug. 20, 2001

(87) PCT Pub. No.: WO01/11219

PCT Pub. Date: Feb. 15, 2001

(30) Foreign Application Priority Data

Aug. 4, 1999 (DE) ..... 199 36 667

(51) Int. Cl.[7] ..... F02M 41/16

(52) U.S. Cl. ..... 239/96; 239/88; 239/124; 123/447

(58) Field of Search ..... 239/88–96, 124; 123/447, 467, 496

(56) References Cited

U.S. PATENT DOCUMENTS

| | | | | |
|---|---|---|---|---|
| 5,183,019 A | * | 2/1993 | Suhara | 123/447 |
| 5,711,277 A | | 1/1998 | Fuseya | |
| 5,820,033 A | * | 10/1998 | Cooke | 239/124 |
| 6,168,087 B1 | * | 1/2001 | Cooke | 239/96 |

FOREIGN PATENT DOCUMENTS

| | | | |
|---|---|---|---|
| DE | 44 46 269 | | 6/1996 |
| EP | 0 331 198 | | 9/1989 |
| EP | 0 334 364 | | 9/1989 |
| EP | 0789142 | * | 3/1997 |

* cited by examiner

*Primary Examiner*—Steven J. Ganey
(74) *Attorney, Agent, or Firm*—Ronald E. Greigg

(57) ABSTRACT

The invention relates to a common rail injector for injecting fuel in a common rail injection system of an internal combustion engine, which system has an injector housing (1) with a fuel inlet (24) that is in communication with a central high-pressure fuel reservoir outside the injector housing (1) and with a pressure chamber (27) inside the injector housing (1), from which fuel subjected to high pressure is injected as a function of the position of a control valve (18) that assures that a nozzle needle (8), which is movable back and forth and received in a longitudinal bore (6) of the injector axially counter to the prestressing force of a nozzle spring (21) that is received in a nozzle spring chamber (20), lifts from a seat when the pressure in the pressure chamber (27) is greater than the pressure in a control chamber (30) that communicates with the fuel inlet (24) via an inlet throttle (19).

To achieve markedly higher nozzle needle speeds, the control chamber (15) is formed by a cylindrical chamber, in which a control peg (12), embodied on the end of the nozzle needle (8) remote from the combustion chamber, is displaceable causing a sealing effect, and that the nozzle spring chamber (20) is disposed outside the control chamber (15), in the region of the end of the nozzle needle (8) remote from the combustion chamber.

14 Claims, 4 Drawing Sheets

COMMON RAIL INJECTOR

CROSS-REFERENCE TO RELATED APPLICATIONS

This application is a 35 USC 371 application of PCT/DE 00/02530 filed on Aug. 1, 2000.

BACKGROUND OF THE INVENTION

1. Field of the Invention

The invention relates to a common rail injector for injecting fuel in a common rail injection system of an internal combustion engine, which system has an injector housing with a fuel inlet that is in communication with a central high-pressure fuel reservoir outside the injector housing and with a pressure chamber inside the injector housing, from which fuel subjected to high pressure is injected as a function of the position of a control valve that assures that a nozzle needle, which is movable back and forth and received in a longitudinal bore of the injector axially counter to the prestressing force of a nozzle spring that is received in a nozzle spring chamber, lifts from a seat when the pressure in the pressure chamber is greater than the pressure in a control chamber that communicates with the fuel inlet via an inlet throttle.

2. Description of the Prior Art

In common rail injection systems, a high-pressure pump pumps the fuel into the central high-pressure fuel reservoir, which is called a common rail. From the high-pressure fuel reservoir, high-pressure lines lead to the individual injectors, which are assigned to the engine cylinders. The injectors are triggered individually by the engine electronics. The rail pressure prevails in the pressure chamber and at the control valve. When the control valve opens, the nozzle needle lifts from its seat counter to the prestressing force of the nozzle spring, and fuel subjected to high pressure is injected into the combustion chamber.

In conventional injectors of the kind known for instance from German Patent Disclosures DE 197 24 637 A1, relatively long nozzle needles are used. In operation, because of the high pressures and the rapid load changes, very strong forces act on the nozzle needle. These forces cause the nozzle needle to be stretched and compressed in the longitudinal direction. This in turn means that the nozzle needle stroke varies as a function of the forces acting on the nozzle needle.

SUMMARY OF THE INVENTION

It is the object of the invention to furnish a common rail injector that while using conventional injection nozzles makes markedly higher nozzle needle speeds possible. Furthermore, the injector of the invention should be simple in construction and should be able to be produced economically.

In a common rail injector for injecting fuel in a common rail injection system of an internal combustion engine, which system has an injector housing with a fuel inlet that is in communication with a central high-pressure fuel reservoir outside the injector housing and with a pressure chamber inside the injector housing, from which fuel subjected to high pressure is injected as a function of the position of a control valve that assures that a nozzle needle movable back and forth and received in a longitudinal bore of the injector axially counter to the prestressing force of a nozzle spring that is received in a nozzle spring chamber, lifts from a seat when the pressure in the pressure chamber is greater than the pressure in a control chamber that communicates with the fuel inlet via an inlet throttle, this object is attained in that the control chamber is formed by a cylindrical chamber, in which a control peg, embodied on the end of the nozzle needle remote from the combustion chamber, is displaceable causing a sealing effect, and that the nozzle spring chamber is disposed outside the control chamber, in the region of the end of the nozzle needle remote from the combustion chamber. It is also conceivable to accommodate the nozzle spring in the control chamber. Then, however, the installation space of the nozzle spring can unfavorable impact the function of the injector. To achieve acceptable closing speeds, a high spring rigidity is necessary, which in turn requires a large installation space. This increases the control chamber volume, and the performance of the injector becomes worse. This impairs in particular the definition of the instant of injection and the length of injection. Furthermore, the requisite control quantity is increased, so that the overall efficiency drops and there is a risk of excessive fuel heating. The invention offers the advantage that the control chamber and the nozzle spring chamber can be combined on the end remote from the combustion chamber of the nozzle needle, without the volume of the control chamber depending on the structural space of the nozzle spring. It is therefore possible to build in a nozzle spring with high spring rigidity, which assures good closure of the nozzle needle. As a result, the injection time and the instant of injection can be defined exactly. With the injector of the invention, nozzle needle speeds that are greater than 1 m/s can be attained during opening and closing. Because of the control peg that is displaceable in the control chamber, the nozzle needle diameter can be selected arbitrarily. By separating the functional measure, or length, which for instance can amount to 3 mm, and the production measure, or length, which can for instance amount to 4 mm, production costs are reduced.

A particular type of embodiment of the invention is characterized in that the fuel inlet discharges into the nozzle spring chamber, and that at least one flat face is embodied on the nozzle needle between the nozzle spring chamber and the pressure chamber. As a result of the flat face, a flow connection is created between the nozzle spring chamber and the pressure chamber, through which the fuel to be injected reaches the pressure chamber from the fuel inlet. The bore to the pressure chamber which is present in conventional injectors can be omitted.

A particular type of embodiment of the invention is characterized in that the control chamber is embodied in a valve piece, which has a central outlet bore with an outflow throttle and a valve seat. Through the central outlet bore, a communication between the control chamber and a relief chamber is created. The valve seat cooperates with a control valve member of a 2/2-way valve, which controls the course of injection of the injector of the invention.

Further particular types of embodiment of the invention are characterized in that the inlet throttle is integrated with either the valve piece or the nozzle needle. The inlet throttle can take the form of a bore or a groove. For production and/or cost reasons, one or the other type of embodiment will be preferable.

A particular type of embodiment of the invention is characterized in that the nozzle needle is guided by the control peg. Because of the functional principle according to the invention, no internal leakage at the guide occurs in the unactuated state. This means lower specific consumption values.

A particular type of embodiment of the invention is characterized in that the nozzle needle is guided on its end toward the combustion chamber. The additional guidance of the nozzle needle increases the operating reliability and the service life of the injector.

A particular type of embodiment of the invention is characterized in that a step which forms a stop for a spring plate is embodied on the nozzle needle. The spring plate forms an abutment for the nozzle spring and at the same time forms the stroke stop for the nozzle needle. By the choice of a suitable thickness of the spring plate, both the prestressing force of the nozzle spring and the nozzle needle stroke can be adjusted.

BRIEF DESCRIPTION OF THE DRAWINGS

Further advantages, characteristics and details of the invention will become apparent from the ensuing description, in which various exemplary embodiments of the invention are described in detail in conjunction with the drawing, in which.

DESCRIPTION OF THE PREFERRED EMBODIMENTS

Figure 1:
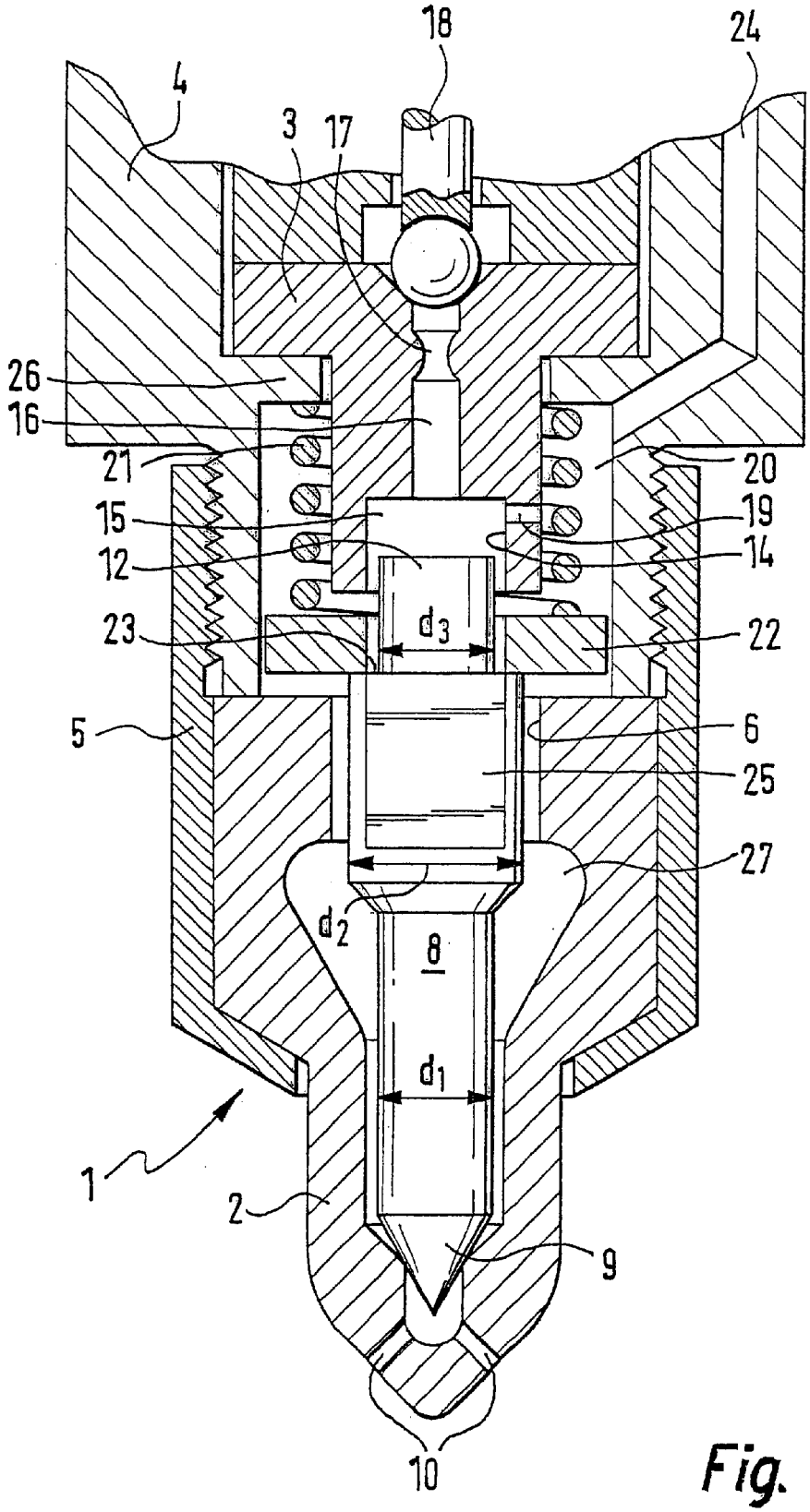
FIG. 1 is a fragmentary sectional view of a first exemplary embodiment of an injector of the invention with an inlet throttle in the valve piece.

The first exemplary embodiment of the injector of the invention, shown in longitudinal section in FIG. 1, has an injector housing identified overall by reference numeral 1. The injector housing 1 includes a nozzle body 2, which protrudes with its lower, free end into the combustion chamber of the internal combustion engine to be supplied. With its upper end face, remote from the combustion chamber, the nozzle body 2 is axially braced by a lock nut 5 against a valve body 3 and an injector body 4. A circumferential rib 26 extending all the way around on the inside is embodied on the retaining body 4. A valve piece 3 is braced with a collar on the circumferential rib 26.

An axial longitudinal bore 6 is recessed out of the nozzle body 2. A nozzle needle 8 is received axially displaceably in the longitudinal bore 6. A sealing face is embodied on the tip 9 of the nozzle needle 8, and this face cooperates with a sealing seat that is embodied on the nozzle body 2. When the tip 9 of the nozzle needle 8 is located with its sealing face in contact with the sealing seat, an injection port 10 in the nozzle body 2 is closed. When the nozzle needle tip 9 lifts from its seat, fuel subjected to high pressure is injected through the injection port 10 into the combustion chamber of the engine.

Beginning at the tip 9, the nozzle needle 8 has three regions of different diameters $d_1$, $d_2$ and $d_3$. The diameter $d_2$ is the largest, and the diameters $d_1$ and $d_3$, in the present exemplary embodiment, are of equal size but can also be different. The end remote from the combustion chamber of the nozzle needle 8 having the diameter $d_3$ forms a control peg 12, which is guided axially displaceably in a central bore 14 in the valve piece 3.

The central bore 14 and the end face, remote from the combustion chamber, of the control peg 12 of the nozzle needle 8 define a control chamber 15. The control chamber 15 can be made to communicate via a fuel outlet 16 with a relief chamber (not shown). An outflow throttle 17 is provided in the fuel outlet 16. With the aid of a control valve member 18, the fuel outlet 16 can be opened and closed.

Through an inlet throttle 19, fuel can reach the control chamber 15. The inlet throttle 19 connects the control chamber 15 to a nozzle spring chamber 20. The nozzle spring chamber 20 communicates with a fuel inlet 24, through which fuel subjected to high pressure from the rail (not shown) reaches the nozzle spring chamber 20. A nozzle spring 21 is disposed in the nozzle spring chamber 20. The nozzle spring 21 is braced by one end on the circumferential rib 26 of the retaining body 4. By its other end, the nozzle spring 21 is braced on a spring plate 22. The prestressing force of the nozzle spring 21 is transmitted to the nozzle needle 8 by the spring plate 22. For that end, a step 23 is formed on the nozzle needle 8 between the control peg 12 having the diameter $d_3$ and the portion of the nozzle needle 8 having the diameter $d_2$.

In the portion of the nozzle needle 8 having the diameter $d_2$, a flat face 25 is formed. The flat face 25 creates a communication between the nozzle spring chamber 20 and a pressure chamber 27, which forms a fuel reservoir. When the fuel outlet 16 is closed by the control valve member 18, rail pressure prevails in the control chamber 15 and the pressure chamber 27. The prestressing force of the nozzle spring 21 then assures that the tip 9 of the nozzle needle 8 will remain in contact with its associated seat on the nozzle body 2. In this position of the nozzle needle 8, no injection takes place.

When the control valve member 18 opens the fuel outlet 16, the pressure in the control chamber 15 drops. In the pressure chamber 27, rail pressure still prevails as before. As a result, the nozzle needle 8 with its tip 9 lifts from the associated seat, and fuel is injected into the combustion chamber of the engine. When the control valve member 18 closes the fuel outlet 16 again, the pressure in the control chamber 15 rises, which causes the nozzle needle 8 to close.

The valve piece 3 and the control valve member 18 form a servo valve. The servo valve can be embodied as a singly or doubly switching valve. As valve positioners, magnets or piezoelectric elements can be used. In the exemplary embodiment shown in FIG. 1, the inlet throttle 19 is located in the valve piece 3. For production and cost reasons, the inlet throttle can also be embodied in some other component, such as the nozzle needle 8. What is important is that the nozzle spring 21 be located outside the control chamber 15. The prestressing and the stroke can be adjusted by the thickness of the spring plate 22. Instead of one flat face 25, a plurality of flat faces can also be provided on the nozzle needle 8. The flow cross section resulting from the flat faces agrees with the inlet bore of a conventional nozzle.

If no injection is taking place, the nozzle needle 8 is pressed into the seat by the rail pressure. The total of the control chamber closing force and the nozzle spring closing force predominates over the seat force at the needle seat. The injection is initiated by the pressure relief of the control chamber 15. The nozzle needle 8 lifts from its seat and in the final stroke, with the spring plate 22, it strikes the valve piece 3. The opening and closing speed are determined, given a fixed outlet/inlet ratio, by the cross section of the control peg 12, whose positively displaced volume acts like an additional source (in the opening process) or sink (in the closing process). In order not to shift the balance of forces between the needle seat and the control peg unilaterally, in conventional common rail systems with a thrust rod, one must reduce the needle diameter from 4 mm to approximately 3 to 3.5 mm. The production and cost aspects are problematic here. The advantage of the invention is that the hydraulically effective diameter is independent of the geometrically predetermined needle diameter. As soon as the control valve member 18 closes again, the pressure in the control chamber 15 rises, and the nozzle needle 8 returns to its seat.

Figure 2:
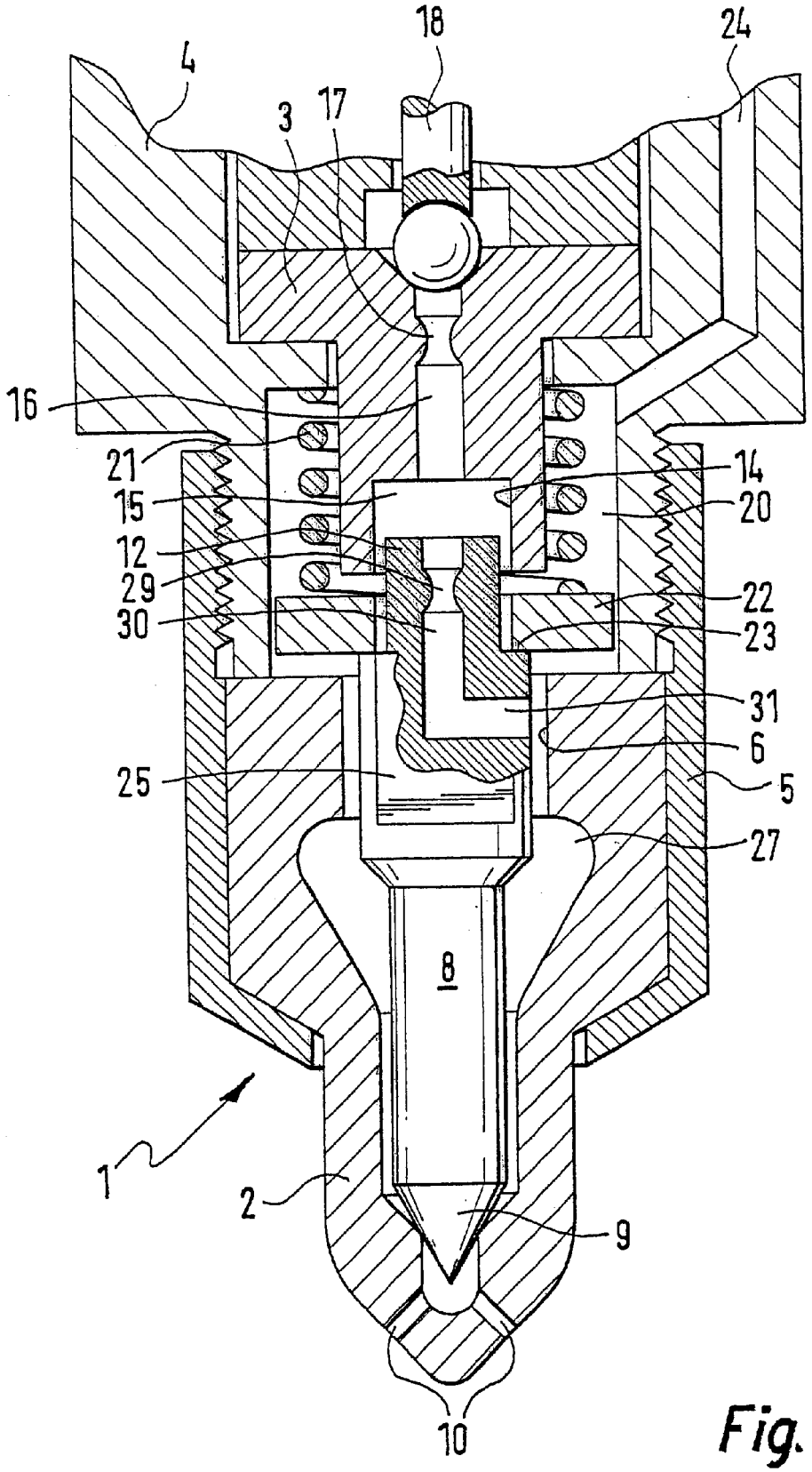
FIG. 2 is a view similar to FIG. 1 and showing a second exemplary embodiment of an injector of the invention with an inlet throttle in the nozzle needle.

The exemplary embodiment shown in FIG. 2 is largely equivalent to the first exemplary embodiment of the invention shown in FIG. 1. For the sake of simplicity, the same reference numerals are used to designate identical parts. In addition, to avoid repetition, reference is made to the above description of the first exemplary embodiment. Below, only the distinctions between the two exemplary embodiments will be addressed. The procedure will be analogous for the extensive description of the exemplary embodiments shown in FIGS. 3–4.

In the second exemplary embodiment shown in FIG. 2, the inlet throttle is disposed not in the valve piece 3 but in the nozzle needle 8. Fuel subjected to high pressure reaches the control chamber 15, via a radial bore 31 and an axial bore 30 with an inlet throttle 29.

Figure 3:
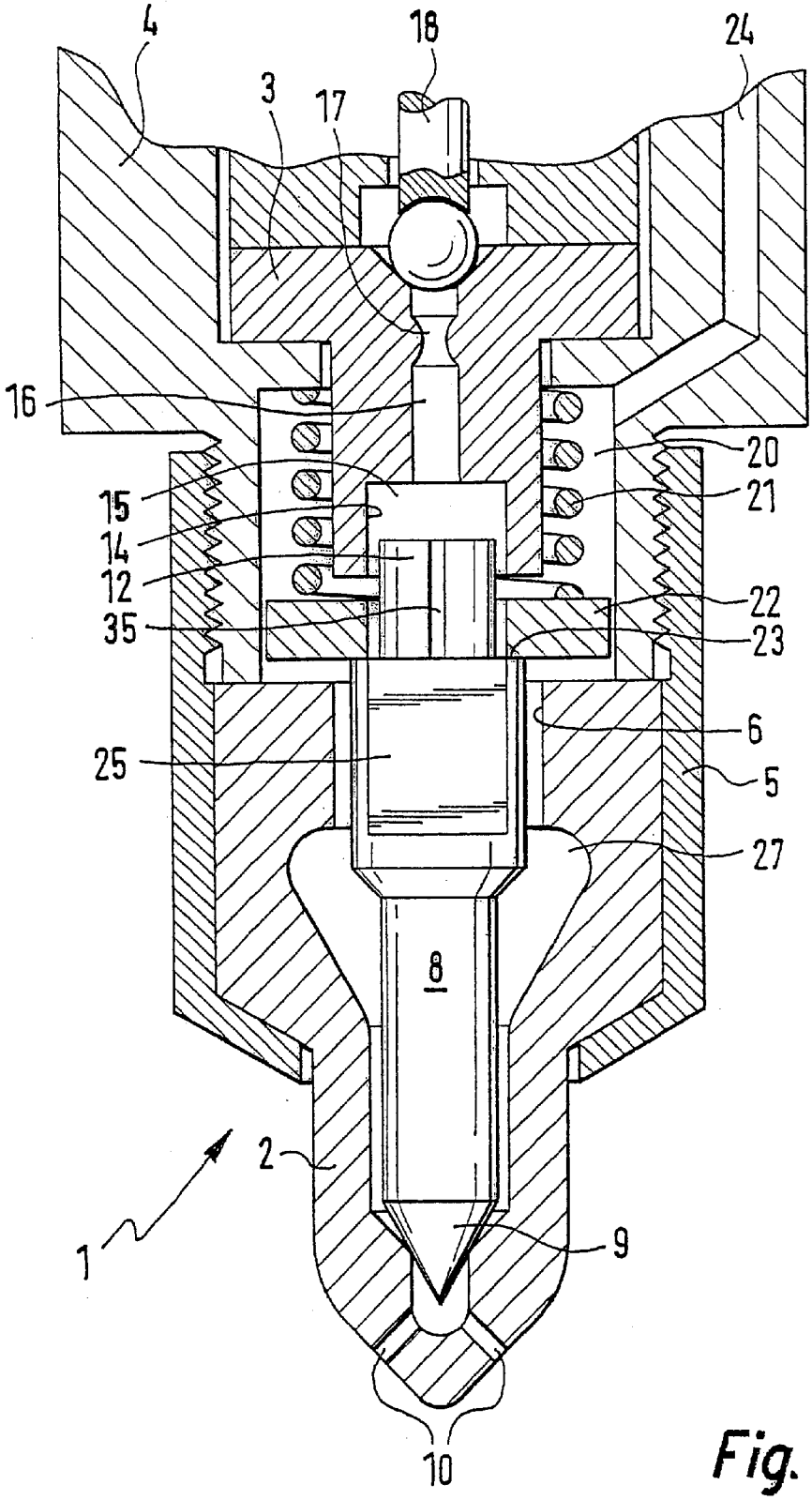
FIG. 3 illustrates a third exemplary embodiment of an injector of the invention with a throttle groove in the nozzle needle.

In the third exemplary embodiment shown in FIG. 3, the inlet throttle takes the form of an axial groove 35, which is made on the control peg 12. Through the axial groove 35, fuel at high pressure from the region of the flat face 25 on the nozzle needle 8 reaches the control chamber 15.

Figure 4:
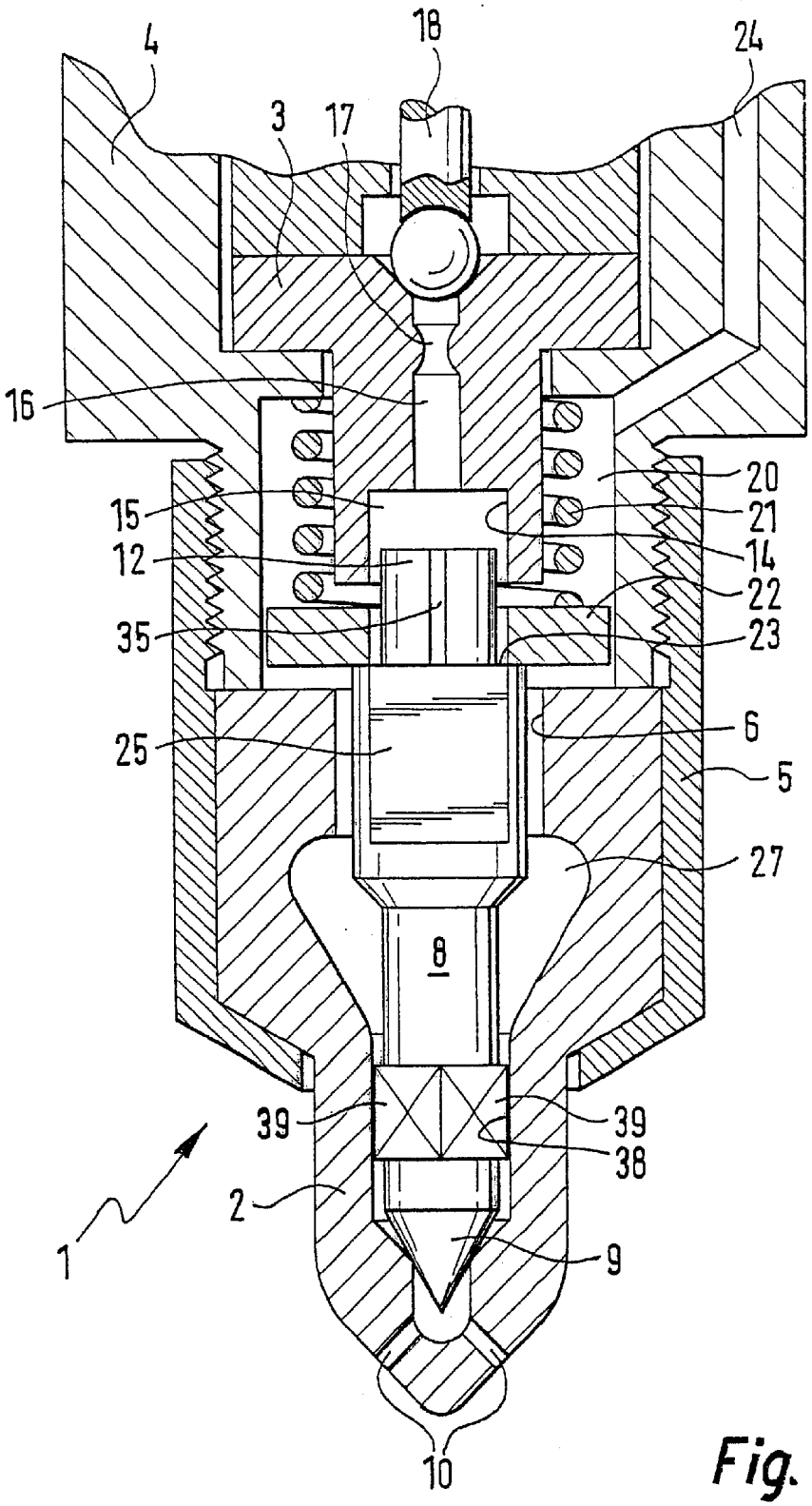
FIG. 4 illustrates a fourth exemplary embodiment of an injector of the invention with a throttle groove and separate needle guidance.

In the exemplary embodiment shown in FIG. 4, unlike the third exemplary embodiment above, an additional guide 38 is formed on the end toward the combustion chamber of the nozzle needle 8. A plurality of flat faces 39 assure a flow connection from the pressure chamber 27 to the nozzle needle tip 9.

The foregoing relates to preferred exemplary embodiments of the invention, it being understood that other variants and embodiments thereof are possible within the spirit and scope of the invention, the latter being defined by the appended claims.

We claim:

1. In a common rail injector for injecting fuel in a common rail injection system of an internal combustion engine, which system has an injector housing (1) with a fuel inlet (24) that is in communication with a central high-pressure fuel reservoir outside the injector housing (1) and with a pressure chamber (27) inside the injector housing (1), from which fuel subjected to high pressure is injected as a function of the position of a control valve (18) that assures that a nozzle needle (8), which is movable back and forth and received in a longitudinal bore (6) of the injector axially counter to the prestressing force of a nozzle spring (21) that is received in a nozzle spring chamber (20), lifts from a seat when the pressure in the pressure chamber (27) is greater than the pressure in a control chamber (15) that communicates with the fuel inlet (24) via an inlet throttle (19), the improvement wherein the control chamber (15) is formed by a cylindrical chamber, into which a control peg (12), embodied on the end of the nozzle needle (8) remote from the combustion chamber, is displaceable causing a sealing effect, and that the nozzle spring chamber (20) is disposed outside the control chamber (15), in the region of the end of the nozzle needle (8) remote from the combustion chamber, wherein the fuel inlet (24) discharges into the nozzle spring chamber (20), and that at least one flat face (25) is embodied on the nozzle needle (8) between the nozzle spring chamber (20) and the pressure chamber (27).

2. The common rail injector of claim 1, wherein the control chamber (15) is embodied in a valve piece (3), which has a central outlet bore (16) with an outflow throttle (17) and a valve seat.

3. The common rail injector of claim 2, wherein the inlet throttle is provided in a bore (19) in the valve piece (3), which bore connects the control chamber (15) with the nozzle spring chamber (20).

4. The common rail injector of claim 2, wherein the inlet throttle (30, 31; 35) is integrated with the nozzle needle (8).

5. The common rail injector of claim 4, wherein the inlet throttle (29) is disposed in a central bore (30) in the nozzle needle (8), which bore communicates with the nozzle spring chamber (20) via a radial bore (31).

6. The common rail injector of claim 4, wherein the inlet throttle is formed by a groove (35), which extends in the longitudinal direction of the nozzle needle (8) and is provided on the control peg (12).

7. The common rail injector of claim 2, wherein the nozzle needle (8) is guided by the control peg (12).

8. The common rail injector of claim 2, wherein the nozzle needle (8) is guided on its end (38) toward the combustion chamber.

9. The common rail injector of claim 2, wherein a step (23) which forms a stop for a spring plate (22) is embodied on the nozzle needle (8).

10. The common rail injector of claim 1, wherein the nozzle needle (8) is guided by the control peg (12).

11. The common rail injector of claim 1, wherein the nozzle needle (8) is guided on its end (38) toward the combustion chamber.

12. The common rail injector of claim 1, herein a step (23) which forms a stop for a spring plate (22) is embodied on the nozzle needle (8).

13. The common rail injector of claim 1, wherein the inlet throttle is disposed in a central bore (30) in the nozzle needle (8), which bore communicates with the nozzle spring chamber (20) via a radial bore (31).

14. The common rail injector of claim 1, wherein the inlet throttle is formed by a groove (35), which extends in the longitudinal direction of the nozzle needle (8) and is provided on the control peg (12).

* * * * *